US005720436A

United States Patent [19]

Buschor

[11] Patent Number: 5,720,436

[45] Date of Patent: Feb. 24, 1998

[54] ELECTROSTATIC SPRAY DEVICE FOR COATING MATERIAL

[75] Inventor: Karl Buschor, St Gallen, Switzerland

[73] Assignee: Gema Volstatic AG, Switzerland

[21] Appl. No.: 680,278

[22] Filed: Jul. 11, 1996

[30] Foreign Application Priority Data

Aug. 2, 1995 [DE] Germany ..... 195 28 398.8

[51] Int. Cl.[6] ..... B05B 5/025

[52] U.S. Cl. ..... 239/706; 239/600

[58] Field of Search ..... 239/3, 704–707, 239/690, 654, 600

[56] References Cited

U.S. PATENT DOCUMENTS

| | | | |
|---|---|---|---|
| 3,937,401 | 2/1976 | Luderer et al. | 239/15 |
| 4,774,102 | 9/1988 | Kiefer et al. | 427/26 |
| 4,852,810 | 8/1989 | Behr et al. | 239/706 X |
| 4,921,172 | 5/1990 | Belman et al. | 239/706 X |
| 5,056,720 | 10/1991 | Crum et al. | 239/600 X |
| 5,402,940 | 4/1995 | Haller et al. | 239/600 X |

FOREIGN PATENT DOCUMENTS

| | | | |
|---|---|---|---|
| 0620045 | 10/1994 | European Pat. Off. . | |
| 0637466 | 2/1995 | European Pat. Off. . | |
| 2731712 | 1/1978 | Germany . | |
| 255482 | 3/1987 | Germany . | |
| 4312262 | 10/1994 | Germany . | |
| 4325911 | 2/1995 | Germany . | |
| 435054 | 10/1967 | Switzerland | 239/706 |
| 88/10152 | 12/1988 | WIPO | 239/706 |
| WO 91/07232 | 5/1991 | WIPO . | |

*Primary Examiner*—Kevin Weldon

*Attorney, Agent, or Firm*—MacMillan, Sobanski & Todd

[57] ABSTRACT

Electrostatic spray device for coating powder or liquid with at least one charging electrode for electrostatic charging the coating material. The device has at least one, and preferably a plurality, of counter electrodes for the electrostatic removal of free charges (electrons or ions) from the stream of sprayed coating material adjacent a coating material discharge nozzle on the device. The counter electrodes are carrier by a ring which is slipped onto a body of the device. A sleeve screwed onto the body holds the ring in an axial direction on the body. An electrical line for discharging the free charges from the counter electrodes is secured to the ring. The electrical line passes through and is confined in a bore in the body to prevent rotation and axial movement of the ring on the body. When the sleeve is removed from the body, the counter electrode ring and attached electrical line can be withdrawn from the body in the axial direction as a unit.

12 Claims, 1 Drawing Sheet

ELECTROSTATIC SPRAY DEVICE FOR COATING MATERIAL

TECHNICAL FIELD

The invention relates to electrostatic coating devices and more particularly to an electrostatic coating device for the electrostatic application of powder or liquid materials and which includes a counter electrode for the removal of free charges from the sprayed material.

BACKGROUND ART

One known spray device for coating powder features a plurality of opposite or counter electrodes arranged in a ring mounted coaxially with a powder duct. The electrode ring is located upstream of a spray nozzle which deposits the coating material on an article to be coated. A high voltage charging electrode is connected to an electric voltage ranging between 4,000 and 140,000 volts and is ganged near the orifice of the spray nozzle. The charging electrode electrostatically charges the coating material. The counter electrodes are connected to an opposite potential from the charging electrode, preferably to ground potential. This causes free charges (electrons and ions) from the electrical space charge generated by the charging electrode to be attracted toward the counter electrode and dissipated to the opposite potential. This allows heavier films of material to be applied on an article being coated with good finish quality, for example, without producing an "orange peel effect" on the film. The counter electrodes electrically connect via an electric line to an electric wiring element on the rear end of the device for connection to the opposite potential. The ring supporting the counter electrodes is joined to a sleeve permanently and immovably relative to it. The sleeve keeps the spray nozzle positioned against a base of the spray device. The sleeve is threaded on the base. To allow the sleeve and the ring to be turned relative to the base, for this threading operation, the electric line for dissipation of the electric charges from the counter electrodes has a two-part design. The two electrical line parts are detachably connected with each other by a slip ring.

Depending on the type of article to be coated and the kind of coating desired, better coating results may in some cases be obtained by using a spray device with the counter electrodes and in other cases by using a spray device without the counter electrodes. Practice has shown that, when spraying is meant to be performed without the counter electrode, the operator removes the counter electrode and the front line section connected to it from the spray device, whereas the rear line section often is inadvertently left in the spray device or not removed for lack of care. The rear line section, although to a lesser extent, continues then to act as an counter electrode, which is undesirable.

The prior art also shows an electrostatic spray device in which an counter electrode device is comprised of a ring suited for slipping on the front section of the spray device. The ring supports several counter electrodes, an electric line extending rearward from the ring, in the form of a plastic rod, and an electric conductor accommodated in it. The entire counter electrode device is thus arranged on the outer circumference of the spray device and allows easy attachment or removal. An advantage is that existing spray devices also may be retro fitted with such an counter electrode device. But the disadvantage is that the counter electrode device soils easily and the line as well as the ring require a stable construction.

DISCLOSURE OF INVENTION

According to the invention, an electrostatic spray coating device is provided with counter electrodes which are easily removed when not needed. The spray device has a body with a forward end which terminates at a nozzle assembly. The counter electrodes are mounted on a ring or tubular sleeve which slides axially over the forward body end. The electrode ring is then retained on the body by a sleeve which is threaded onto the forward body end. A line is permanently secured to the electrode ring for connecting to a terminal at a rear end of the device body. The line passes through a passage in the body which is sufficiently small to prevent rotation of the ring about the axis of the body. The sleeve retains the line in the body passage. When the ring is removed from the spray device, it is removed as a unit with the attached line and when it is installed on the spray device, it is installed as a unit with the attached line. Consequently, the ring cannot be removed without removing the attached line nor can it be installed without the attached line.

The objective of the invention is to fashion an electrostatic spray device for coating powder or for liquid coating material in such a way that it can be used easily with or without counter electrodes. The intention reliably prevents the counter electrode line parts from being forgotten in the spray device, without requiring said counter electrode line parts to be arranged externally on the spray device.

Other objects and advantages of the invention will become apparent from the following detailed description of the invention and the accompanying drawings.

BEST MODE FOR CARRYING OUT THE INVENTION

Figure 1:
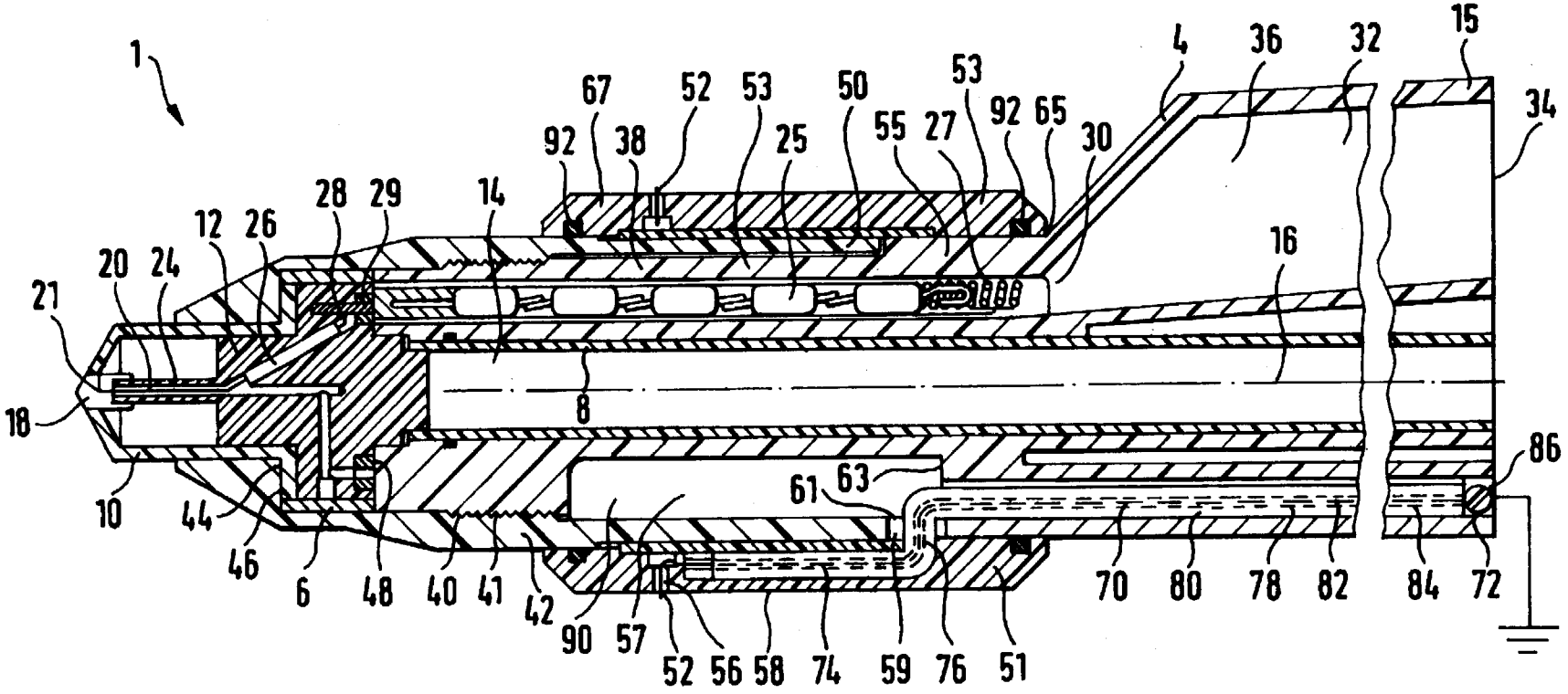
FIG. 1, a fragmentary longitudinal section through a spray device with counter electrodes according to the invention.

The electrostatic spray device 1 illustrated in FIG. 1 is desired for electrostatic spray coating with a coating powder which, once sprayed on an article, is melted and is baked on it. However, the spray device 1 can in modified form be used to spray liquid coating material, as will be readily apparent to those skilled in the art.

The spray device 1 includes a body 4 of electrically insulating material, a tube 8 extending through the body 4, an adapter 12 following the tube 8 downstream of the body 4 and a nozzle 10. The tube 8, the adapter 12, a surrounding bushing 6, and the nozzle 10 are of electrically insulating material and form a coating material duct 14 having an axis 16. Powder is pneumatically fed through the powder duct 14 from an upstream rear part 15 and is discharged through an orifice 18 formed in the nozzle 10. The nozzle 10 may contain a metal insert in which the orifice 18 is formed. The powder is sprayed through the orifice 18 on an article being coated (not shown). The adapter 12 is a narrow plate which allows the coating powder to flow axially past it. The adapter 12 supports a needle-shaped charging electrode 20 in an air duct 24 on the duct axis 16. The charging electrode 20 and its electrode tip 21 are swept near the orifice 18 by compressed air from the air duct 24 to prevent a buildup of coating material on the charging electrode 20. The charging electrode 20 connects via an electric conductor 26 in the adapter 12, via electric contacts 28, 29 that follow upstream thereof, via an electric resistance column 25 and a compression spring 27 to a high-voltage output terminal 30 of a high voltage generator 32. The voltage generator 32 is preferably a known cascade circuit of electric resistors, capacitors and rectifiers. The voltage generator 32, the compression spring 27 and the electric resistance column 25 are located in a conduit 36 extending through the body 4 generally parallel to the material duct 14. The conduit 36 and also the body 4 have a volume in the area of the voltage generator 32 which expands upwardly to the rear of a lower front body section 38. The resistance column 25 is housed in the lower front section 38.

The voltage generator 32 features a low-voltage input (not shown) on a rear end 34 of the device, for connection to an external electric low-voltage source (not shown). Preferably, the low voltage ranges, for example, between 6 volts and 24 volts AC. The high voltage applied to the charging electrode 20 ranges, for example, between 4 kV and 140 kV. The voltage generator 32 can be removed from the body 4 toward the rear end 34. Upon pulling the adapter 12 axially forward from the body front section 38, which causes separation of the electric contacts 28 and 29, the resistance column 25 can be pulled forward out of the front section 38 of the body 4.

The body 4 features on its cylindrical front section 38 an external thread 40 on which an insulated sleeve 42 with an internal thread 41 is screwed. The sleeve 42 is slipped over the nozzle 10 and is pushed until a rearwardly facing radial end face 44 engages a forwardly facing radial end face 46 of the nozzle 10. As the sleeve 42 is screwed on the front section 38, it clamps the nozzle 10 and the adapter 12 against a forwardly facing radial end face 48 on the body 4. The conduit 36 extends to the forwardly facing radial end face 48 on body 4. Thus, removal of the nozzle 10, the adapter 12 and the resistance column 25 requires merely unscrewing the sleeve 42 from the body 4. A rear section 50 on the sleeve 41 extends rearwardly beyond the internal thread 41.

To the rear of the thread 40, the cylindrical front section 38 of body 4 has an unthreaded section 53 which preferably has a slightly larger diameter than the thread 40. Behind the unthreaded section 53, the body front section 38 has a rear end section 55 of larger diameter, its diameter preferably equaling the outside diameter of the sleeve 42, so that it is axially flush with an outer surface of the sleeve 42.

A tubular sleeve or ring 51 of electrically insulating material supports at least one and preferably a plurality of needle shaped counter electrodes 52. The electrodes 52 are arranged coaxially in ring fashion around the material duct 14. The counter electrodes 52 are contained in radial bores 56 in the ring 51 which open at an outer surface 58. The ring 51 extends around the material duct 14 coaxially with the duct axis 16, with a radial and axial clearance existing between the counter electrodes 52 and the charging electrode 20.

A slotted recess 57 is fashioned in the outer circumference of the front section 38 of body 4. The slotted recess 57 extends from the rear end section 55 of the front body section 38 up to the external thread 40 and is covered by the sleeve 42, except for a small radial conduit 59. The radial conduit 59 is formed between a rear end 61 of the sleeve 42 and an opposing rear end-wall 63 of the recess 57.

The inside diameter of the ring 51 is only slightly larger (less than 1 mm) than the outside diameter of the sleeve 42. Before screwing the sleeve 42 onto the body 4, the ring 51 is slipped from the front over the front body section 38 onto the rear end section 55 of said front section 38 up to a stop 65 on the body 4. The sleeve 42 is then threaded onto the body 4 to extend with its rear section 50 between body and a front section 67 of the ring 51. The ring 51 extends across the length of the recess 57. The ring 51 is retained in its axial position by the stop 65 of body 4 and the sleeve 42. Preferably, two O-ring seals 92 are contained between ring 51 and the opposite outer peripheral surfaces of body 4 and the sleeve 42.

The ring 51 is positioned in forward, rearward and peripheral direction around material duct 14 also by an electric line 70. The line 70 extends from the radially inner ends of the counter electrodes 52 up to an electrical counter potential terminal 72 on the rear end 34 of the rear end section 55 of the device 1. The line 70 extends essentially parallel to the material duct 14, allowing the counter electrodes 52 to be connected via terminal 72 to a potential which is opposite the potential on the charging electrode 20, preferably to ground potential. The electric opposite potential differs from the electric high-voltage potential of the charging electrode 20 to the effect that the counter electrodes 52 attract free electrons and ions from the electrical space charge cloud adjacent the charging electrode 20, dissipating them to the opposite potential. The counter electrodes 52 are located maximally close to the spray orifice 18, for best electrical efficacy. On the other hand, the counter electrodes 52 must be spaced from the charging electrode 20 sufficiently far to preclude any electrical arc-over and to allow only free electrical charges (electrons and ions) to be sucked off by the counter electrodes 52. None of the electrical charges of the high-voltage electrode 20 that are needed for charging the coating material are dram to the counter electrodes 52. According to a modified embodiment of the invention, the counter electrodes 52 may be shaped differently, for instance formed by an electrode ring.

The electrical line 70 for the counter electrodes 52 consists integrally of a front line section 74 located within the ring 51, an intermediate section 76 which extends substantially radially from the ring 51 through the radial conduit 59 between the sleeve 42 and the forwardly facing rear end face 63 of the recess 57, and of a rearwardly following rear line section 78 in a through bore 80 that extends generally parallel to axis 16 of material duct 14 through the body 4. The bore 80 is provided on its rear end with the counter potential terminal 72. The bore 80 extends with its front end into the forwardly facing rear end face 63 of the recess 57. The intermediate line section 76 gives the line 70 a Z-shaped orthogonal angled shape. Since the line 70 through the bore 80 in the body 4 is situated closer to the axis 16 than the external thread 40 on the body 4, at least the rear line section 78 must be flexible. The flexibility allows the rear line section 78 to be pulled out of the through bore 80, through the recess 57 and forward over the threading 40 or, vice versa, to be slipped into said through bore 80. The intermediate line section 76 is located between the rear end 61 of the sleeve 42 and the forwardly facing rear end-face 63 of the body 4 and is positioned axially between these two elements, whereby the ring 51 is retained in a desired axial position. In the through bore 80, the rear line section 78 preferably has only a little clearance relative to the surrounding bore wall of the body 4. Consequently, the rear line section 78 is held essentially stationary in the through bore 80 and the attached ring 51 is thus prevented from rotation.

The line 70 preferably consists of an electrically conductive core 82 and an electrically insulated shell 84 surrounding the core 82. The core 82 preferably is inserted axially in the opposite-potential terminal 72 and is fastened in the opposite-potential terminal by a screw 86 fitted in the terminal 72. The line 70 is connected to the terminal 72 and also is retained in the axial direction of the device, in a fashion such that the electrical line 70 can be attached to the body 4 or removed from it only together with the ring 51 and not individually. Thus, for a spray coating operation when the counter electrodes 52 are not used, both the ring 51 with the counter electrodes 52 and the line 70 must be removed as a unit. The risk of leaving the rear line section 78 in the through bore is eliminated. This also ensures that when spray coating with the counter electrodes 52, the line 70 always will be present in its entirety and the electrodes 52 will be effective. The electric line 70 has the form of an electric cable or of a rod with limited flexibility.

In this embodiment, or also in a modified embodiment, the ring 51 with the counter electrodes 52, and the line 70 can be prevented from rotating relative to the body 4 around the material duct 14 also by providing side surfaces 90 of the recess 57 that extend in the longitudinal direction of the material duct 14 only a mutual spacing that matches the width of the line 70. This arrangement prevents the line 70 from moving in a peripheral direction around the material duct 14.

It will be appreciated that various modifications and changes may be made to the above described preferred embodiment of without departing from the scope of the following claims. For example, although the body 4 has been illustrated as a single integral unit, it may consist of several parts.

I claim:

1. In an electrostatic spray device for coating material which includes a body and a coating material duct in said body connected to a nozzle mounted on a forward end of said body, said nozzle being adapted to discharge coating material, a charging electrode for imparting an electrostatic charge to coating material discharged from said nozzle, at least one counter electrode arranged outside of the coating material stream at a distance to the rear of the charging electrode, and a conductor extending through a passage in said body and adapted to connect said counter electrode to an electrical counter potential whereby said counter electrode and said conductor are adapted for removing free electrical charges from sprayed coating material, the improvement comprising a ring mounting said counter electrode, said ring having a passage adapted to pass said forward end of said body, wherein said conductor has a first end secured to said counter electrode on said ring and a free second end, wherein said conductor passes through said passage when said ring is placed on said forward body end and is removed from said passage when said ring is removed from said forward body end, and means for releasably retaining said ring on said forward body end.

2. An electrostatic spray device, as set forth in claim 1, and further including means for preventing rotation of said ring on said body.

3. An electrostatic spray device, as set forth in claim 2, and wherein said conductor closely engages said body passage, and wherein said conductor and said body passage form said means for preventing rotation of said ring on said body.

4. An electrostatic spray device, as set forth in claim 2, wherein said body forms a stop limiting the axial position of said ring on said forward body end, and wherein said retaining means includes an internally threaded sleeve releasably engaging a complimentary externally threaded section on said forward body end.

5. An electrostatic spray device, as set forth in claim 4, and wherein said conductor closely engages said body passage, and wherein said conductor and said body passage form said means for preventing rotation of said ring on said body.

6. An electrostatic spray device, as set forth in claim 4, and wherein said sleeve releasably clamps said nozzle to said forward body end.

7. An electrostatic spray device, as set forth in claim 4, and wherein said conductor passage includes a short radially directed portion at an end adjacent said ring and wherein said conductor is confined in said radial portion when said ring is retained on said body.

8. An electrostatic spray device, as set forth in claim 7, and wherein said sleeve extends coaxially between a portion of said ring and said body, and wherein said sleeve cooperates with said body for forming said radially directed passage portion to confine said conductor in said radially directed passage portion and retain said ring on said body.

9. An electrostatic spray device, as set forth in claim 8, and wherein a plurality of counter electrodes are mounted on said ring.

10. An electrostatic spray device, as set forth in claim 1, and wherein said conductor passage includes a short radially directed portion at an end adjacent said ring and wherein said conductor is confined in said radial portion when said ring is retained on said body.

11. An electrostatic spray device, as set forth in claim 10, and wherein said conductor is a flexible wire having an insulated coating.

12. An electrostatic spray device, as set forth in claim 1, and wherein a plurality of counter electrodes are mounted on said ring.

* * * * *